US006094009A

United States Patent [19]

Goebel

[11] Patent Number: 6,094,009

[45] **Date of Patent: *Jul. 25, 2000**

[54] HIGH EFFICIENCY COLLECTOR FOR TRAVELING WAVE TUBES WITH HIGH PERVEANCE BEAMS USING FOCUSING LENS EFFECTS

[75] Inventor: Dan M. Goebel, Tarzana, Calif.

[73] Assignee: Hughes Electronics Corporation, El Segundo, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,843

[22] Filed: Jun. 5, 1997

[51] Int. Cl.[7] ..... H01J 25/34; H01J 23/027

[52] U.S. Cl. ..... 315/3.5; 315/5.35; 315/5.38

[58] Field of Search ..... 315/3.5, 5.35, 315/5.38

[56] References Cited

U.S. PATENT DOCUMENTS

| | | | |
|---|---|---|---|
| 2,325,865 | 8/1943 | Litton | 315/5.38 |
| 3,172,004 | 3/1965 | Von Gutfeld et al. | 315/5.38 X |
| 3,175,126 | 3/1965 | Wendt | 315/5.38 |
| 3,273,006 | 9/1966 | Osepchuk | 315/5.38 X |
| 5,420,478 | 5/1995 | Scheitrum | 315/5.38 |

FOREIGN PATENT DOCUMENTS 2743108A 4/1978 Germany .

OTHER PUBLICATIONS

Yamamoto K. & Morishita Y.: "A New Method for Suppressing BackStreaming Electronics from Potential Depressed Collectors—A Convergent Injection Collection" Transactions of the Institute of Electronics and Communication Engineers of Japan, Section E., vol. E 59, No. 8,pp.20–21, Aug. 1976.

Abstract/Zusammenfassung/Abrege, XS 9810971910 MA.

*Primary Examiner*—Benny T. Lee

*Attorney, Agent, or Firm*—Bradley K. Lortz; Vijayalakshmi D. Duraiswamy; Michael W. Sales

[57] ABSTRACT

A collector for collecting an electron beam in a traveling wave tube is disclosed. The collector has an input end for receiving the electron beam from the traveling wave tube. The collector also has a plurality of stages biased at given voltages and arranged along a common collector axis and positioned at a different axial position with respect to the input end. A stage is biased more negatively with a voltage than a successive stage positioned axially farther from the input end to generate an electrostatic focusing lens for focusing the electron beam toward successive stages thereby increasing the collection efficiency of the collector.

7 Claims, 6 Drawing Sheets

HIGH EFFICIENCY COLLECTOR FOR TRAVELING WAVE TUBES WITH HIGH PERVEANCE BEAMS USING FOCUSING LENS EFFECTS

TECHNICAL FIELD

The present invention relates generally to traveling wave tubes and, more particularly, to collectors for traveling wave tubes.

BACKGROUND ART

An exemplary traveling wave tube (TWT) 20 is illustrated in FIG. 1. The elements of TWT 20 are generally coaxially-arranged along a TWT axis 22. The elements include an electron gun 24, a slow wave structure 26 (embodiments of which are shown in FIGS. 2A and 2B), a beam focusing arrangement 28 which surrounds slow wave structure 26, a microwave signal input port 30 and a microwave signal output port 32 which are coupled to opposite ends of slow wave structure 26, and a collector 34. A housing 36 is typically provided to protect the TWT elements.

In operation, electron gun 24 injects a beam of electrons into slow wave structure 26. The electron beam has a given power level. Beam focusing arrangement 28 guides the electron beam through slow wave structure 26. A microwave input signal 38 is inserted at input port 30 and moves along slow wave structure 26 to output port 32. Slow wave structure 26 causes the phase velocity (i.e., the axial velocity of the phase front of the signal) of the microwave signal to approximate the velocity of the electron beam.

As a result, the electrons of the beam are velocity modulated into bunches which interact with the slower microwave signal. In this process, kinetic energy is transferred from the electrons to the microwave signal causing the signal to be amplified. The amplified signal is coupled from output port 32 as a microwave output signal 40. After their passage through slow wave structure 26, the electrons are collected in collector 34.

The amount of kinetic energy transferred from the electrons to the microwave signal is approximately constant at low microwave signal input power levels. Thus, the gain between the microwave output and input signals is constant. As the power of the microwave signal input increases, nonlinear effects become more significant. Eventually, the microwave output signal reaches a maximum power value and the TWT operates at saturation.

Approaching saturation, the relationship between the microwave output and input signals becomes nonlinear. If the power of the microwave input signal is increased further beyond saturation, the power of the microwave output signal and the gain decrease. A TWT operating below its saturated microwave output power level is referred to as running "backed off" from saturation. The amount of "back off" is the difference in dB between the power levels of "backed off" and saturated microwave output signals. A TWT running at least 3 dB "backed off" from saturation provides a very high amplitude and phase linearity needed for communication applications.

Beam focusing arrangement 28 is configured to develop a magnetic field for guiding the electron beam through slow wave structure 26. A first configuration includes a series of annular, coaxially arranged permanent magnets 42 which are separated by pole pieces 44. Magnets 42 are arranged so that adjacent magnet faces have the same magnetic polarity. This beam focusing configuration is comparatively light weight and is referred to as a periodic permanent magnet (PPM) arrangement. In TWTs in which output power is more important than size and weight, a second configuration often replaces the PPM with a solenoid 46 (partially shown adjacent input port 30) which carries a current supplied by a solenoid power supply (not shown).

As shown in FIGS. 2A and 2B, TWT slow wave structures generally receive an electron beam 48 from electron gun 24 (see FIG. 1) into an axially repetitive structure. A first exemplary slow wave structure is helix member 50 shown in FIG. 2A. A second exemplary slow wave structure is coupled cavity circuit 52 shown in FIG. 2B. Coupled cavity circuit 52 includes annular webs 54 which are axially spaced to form cavities 56. Each of annular webs 54 form a coupling hole 58 which couples a pair of adjacent cavities. Helix member 50 is especially suited for broad band applications while coupled cavity circuit 52 is especially suited for high power applications.

Electron gun 24, helix member 50, and collector 34 are again shown in the TWT schematic of FIG. 3. Electron gun 24 has a cathode 60 and an anode 62. Collector 34 has a first annular collector stage 64, a second annular collector stage 66, and a third collector stage 68. Because third collector stage 68 generally has a cup-like or bucket-like form, it is sometimes referred to as the "bucket" or "bucket stage".

Helix member 50 and a body 70 of TWT 20 are at ground potential. Cathode 60 is biased negatively by a voltage $V_{cath}$ from a cathode power supply 72. An anode power supply 74 is referenced to cathode 60 and applies a positive voltage to anode 62. This positive voltage establishes an acceleration region 76 between cathode 60 and anode 62. Electrons are emitted by cathode 60 and accelerated across the acceleration region 76 to form electron beam 48. The positive and negative terminals of the anode power supply 74 and the cathode power supply 72 are indicated in FIG. 3 by (+/−), respectively.

As described above with reference to FIG. 1, electron beam 48 travels through helix member 50 and exchanges energy with a microwave signal which travels along the helix member from input port 30 to output port 32. Only a portion of the kinetic energy of electron beam 48 is transferred in the energy exchange. Most of the kinetic energy remains in electron beam 48 as it enters collector 34. The electron beam entering collector 34 is referred to as the spent electron beam. A significant part of the kinetic energy of the spent electron beam can be recovered by decelerating the electrons before they are collected by the collector stages.

Because of their negative charge, the electrons of electron beam 48 form a negative "space charge" which causes the electron beam to radially disperse in the absence of any external restraint. Accordingly, beam focusing arrangement 28 applies a magnetic field which restrains the radial divergence of the electrons by causing them to spiral about the beam.

However, electron beam 48 is no longer under this restraint when it enters collector 34 and, consequently, it begins to radially disperse. In addition, the interaction between electron beam 48 and the microwave signal on slow wave structure 26 causes the electrons to have a "velocity spread" as they enter collector 34, i.e., the electrons have a range of velocities and kinetic energies. Depending upon the amount of interaction, some of the electrons may have radial as well as axial velocity components. In short, the microwave signal perturbs electron beam 48. The degree of perturbance is much larger at saturation than at backed off operation.

Negative voltages are applied to collector 34 to achieve electron deceleration. The potential of collector 34 is "depressed" from that of TWT body 70 (i.e., made negative relative to the TWT body). The kinetic energy recovery is further enhanced by using a multistage collector, e.g., collector 34, in which each successive stage is further depressed from the body potential of $V_B$. For example, if first collector stage 64 has a potential $V_1$, second collector stage 66 has a potential $V_2$, and third collector stage 68 has a potential of $V_3$, these potentials are typically related by the equation $V_B=0>V_1>V_2>V_3$ as indicated in FIG. 3. The efficiency of the collector in collecting the kinetic energy from the spent electron beam is referred to as the collection efficiency.

The voltage $V_1$ on first collector stage 64 is depressed sufficiently to decelerate the slowest electrons 80 in electron beam 48 and yet still collect them. If this voltage $V_1$ is depressed too far, first stage 64 repels rather than collects electrons 80. These repelled electrons may flow to TWT body 70 and reduce the efficiency of TWT 20. Alternatively, they may reenter the energy exchange area of helix member 50 and reduce the stability of TWT 20.

Similar to first collector stage 64, successively depressed voltages are applied to successive collector stages to decelerate (but still collect) successively faster electrons in electron beam 48, e.g., electrons 82 are collected by second collector stage 66 and electrons 84 are collected by third collector stage 68.

In operation, the diverging low kinetic energy electrons 80 are repelled by second collector stage 66, which causes their divergent path to be modified so that they are collected on the interior face of the less depressed collector stage 64. Higher energy electrons 82 are repelled by collector stage 68, which causes their divergent paths to be modified so that they are collected on the interior face of the less depressed collector stage 66. Finally, the highest energy electrons 84 are decelerated and collected by collector stage 68. This process of improving the efficiency of TWT 20 by decelerating and collecting successively faster electrons with successively greater depression on successive collector stages is generally referred to as "velocity sorting".

To recover a large fraction of the power of the spent electron beam, the stages must be designed to sort the electrons in the spent beam into various energy classes. Then, electrons in each energy class must be collected on a collector stage at a voltage that recovers as much of that energy as possible.

The gain in the collection efficiency realized by velocity sorting of electron beam 48 can be further understood with reference to current flows through a collector power supply 86 which is coupled between cathode 60 and collector stages 64, 66, and 68. The positive and negative terminals of the collector power supply 86 are indicated on FIG. 3 by (+/−), respectively. If the potential of collector 34 were the same as TWT body 70, the total collector electron current $I_{coll}$ would flow back to cathode power supply 72 as indicated by current 88 in FIG. 3, and the input power to TWT 20 would substantially be the product of the cathode voltage $V_{cath}$ and the collector current $I_{coll}$.

In contrast, the currents of collector 34 flow through collector power supply 86. The input power associated with each collector stage is the product of that stage's current and its associated voltage in collector power supply 86. Because the voltages $V_1$, $V_2$, and $V_3$ of collector power supply 86 are a fraction (e.g., in the range of 30–70%) of the voltage of cathode power supply 72, the TWT input power is effectively decreased.

To increase the collection efficiency, it is desirable that as much of the electron beam as possible is collected by the most negatively depressed stages. It is also desirable that the voltages of the most negatively depressed stages are as large a fraction of the voltage of cathode power supply 72 as possible. It is further desirable that many collector stages be employed in the collector such that many different voltages corresponding to the electron energy classes are applied to the stages.

Efficiencies of TWTs with multistage collectors are typically in the range of 25–60%, with higher efficiency generally associated with narrower bandwidth. These efficiencies can be further improved by enhancing the velocity sorting of collector 34 and considerable efforts have been expended towards this goal in the areas of collector design, simulation, and prototype testing.

However, a problem with successively depressing collector stages to gradually decelerate an electron beam to recover kinetic energy is that this causes high perveance and/or significantly perturbed electron beams to diverge rapidly. Perveance is a measure of the electron beam space charge. Rapid divergence physically limits the ability of the electron beam to reach the most highly depressed collector stages thereby limiting the collector efficiency.

SUMMARY OF THE INVENTION

Accordingly, it is an object of the present invention to provide an electrostatic lens for focusing a diverging electron beam toward the most highly depressed collector stages in a collector.

It is another object of the present invention to provide an electrostatic lens for focusing a diverging electron beam having a perveance of at least 0.25 $\mu$P toward the most highly depressed collector stages in a collector.

It is a further object of the present invention to provide an electrostatic lens for focusing a diverging electron beam toward the most highly depressed collector stages in a collector of a traveling wave tube operating backed off from saturation.

It is yet another object of the present invention to provide an electrostatic lens for focusing a diverging electron beam having a perveance of at least 0.25 $\mu$P toward the most highly depressed collector stages in a collector of a traveling wave tube operating backed off from saturation.

It is still yet another object of the present invention to provide an electrostatic focusing lens in a collector having at least six collector stages.

It is yet a further object of the present invention to provide a multiple stage collector in which an intermediate stage is biased more negatively with a voltage than a successive stage.

It is still yet a further object of the present invention to provide a multiple stage collector having the most highly depressed stages biased at more than 90% of the voltage of the cathode power supply.

In carrying out the above objects and other objects, the present invention provides a collector for collecting an electron beam in a traveling wave tube. The collector includes an input end for receiving the electron beam from the traveling wave tube. The collector further includes a plurality of stages biased at given voltages and arranged along a common collector axis and positioned at a different axial position with respect to the input end. A stage is biased more negatively with a voltage than a successive stage positioned axially farther from the input end to generate an electrostatic focusing lens for focusing the electron beam toward successive stages thereby increasing the collection efficiency of the collector.

Preferably, the stage biased more negatively with a voltage and the successive stage positioned axially farther from the input end are immediately adjacent. In a further preferred embodiment, a magnetic focusing device is operable with the collector for generating an axially-directed magnetic field within the collector to guide the electron beam toward the successive stages.

Further, in carrying out the above objects and other objects, the present invention provides a method for improving the collection efficiency of a collector of a traveling wave tube. The method is for use with a collector having an input end for receiving an electron beam and a plurality of stages biased at given voltages and arranged along a common collector axis and positioned at a different axial position with respect to the input end. The method includes biasing a stage more negatively with a voltage than a successive stage positioned axially farther from the input end for generating an electrostatic focusing lens for focusing the electron beam toward successive stages thereby increasing the collection efficiency of the collector.

The advantages accruing to the present invention are numerous. The electrostatic lens increases the amount of current collected near the cathode potential which increases the collector efficiency. The electrostatic lens is effective for high perveance electron beams (>0.25 $\mu$P) that diverge rapidly during deceleration in typical depressed collectors and for relatively unperturbed electron beams which do not have a significant energy spread that causes some of the electrons to reflect from the lens. Typical collectors receiving an electron beam having a perveance of 0.5 $\mu$P are limited to an 85% collection efficiency. In contrast, the collector of the present invention with the electrostatic focusing lens has a 90% to 96% collection efficiency.

These and other features, aspects, and embodiments of the present invention will become better understood with regard to the following description, appended claims, and accompanying drawings.

BEST MODES FOR CARRYING OUT THE INVENTION

Figure 4:
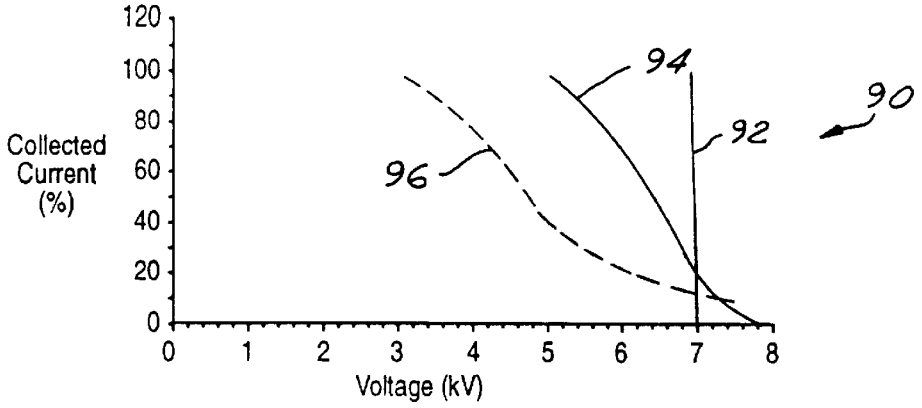
FIG. 4 is a graph of the energy spread of an electron beam for a TWT operating at DC, back off, and saturation.

Referring now to FIG. 4, a graph 90 illustrating the energy spread of an electron beam for three traveling wave tube (TWT) operation modes is shown. Graph 90 includes a plot 92 of a spent electron beam curve for TWT 20 operating at DC (no microwave signal input applied to the TWT), a plot 94 of a spent electron beam curve for the TWT operating 8 dB "backed off" from saturation, and a plot 96 of a spent electron beam curve for the TWT operating at saturation.

Figure 1:
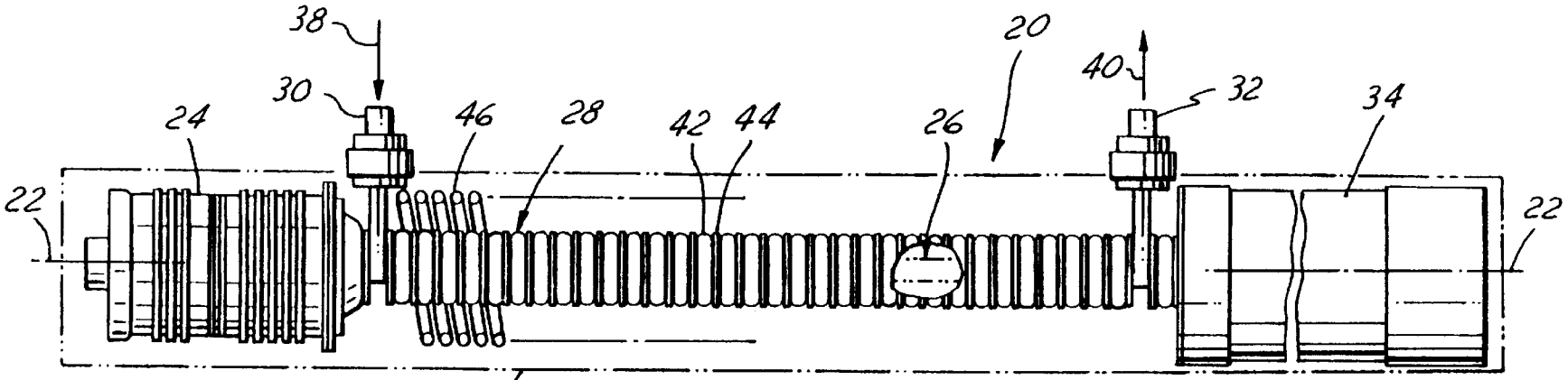
(PRIOR ART) FIG. 1
FIG. 1 is a partially cut away side view of a conventional traveling wave tube (TWT)
Figure 2B:
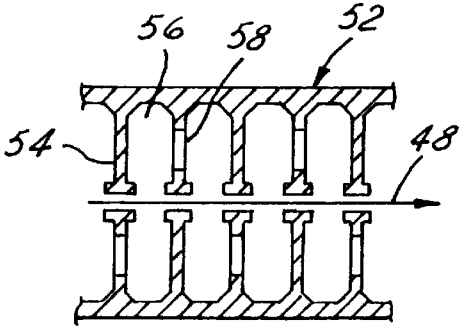
(PRIOR ART) FIG. 2B
FIG. 2B illustrates another conventional slow wave structure in the form of a coupled cavity circuit for use in the TWT of FIG. 1.
Figure 2A:
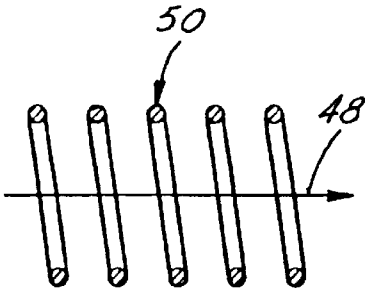
(PRIOR ART) FIG. 2A
FIG. 2A illustrates a conventional slow wave structure in the form of a helix member for use in the TWT of FIG. 1.
Figure 3:
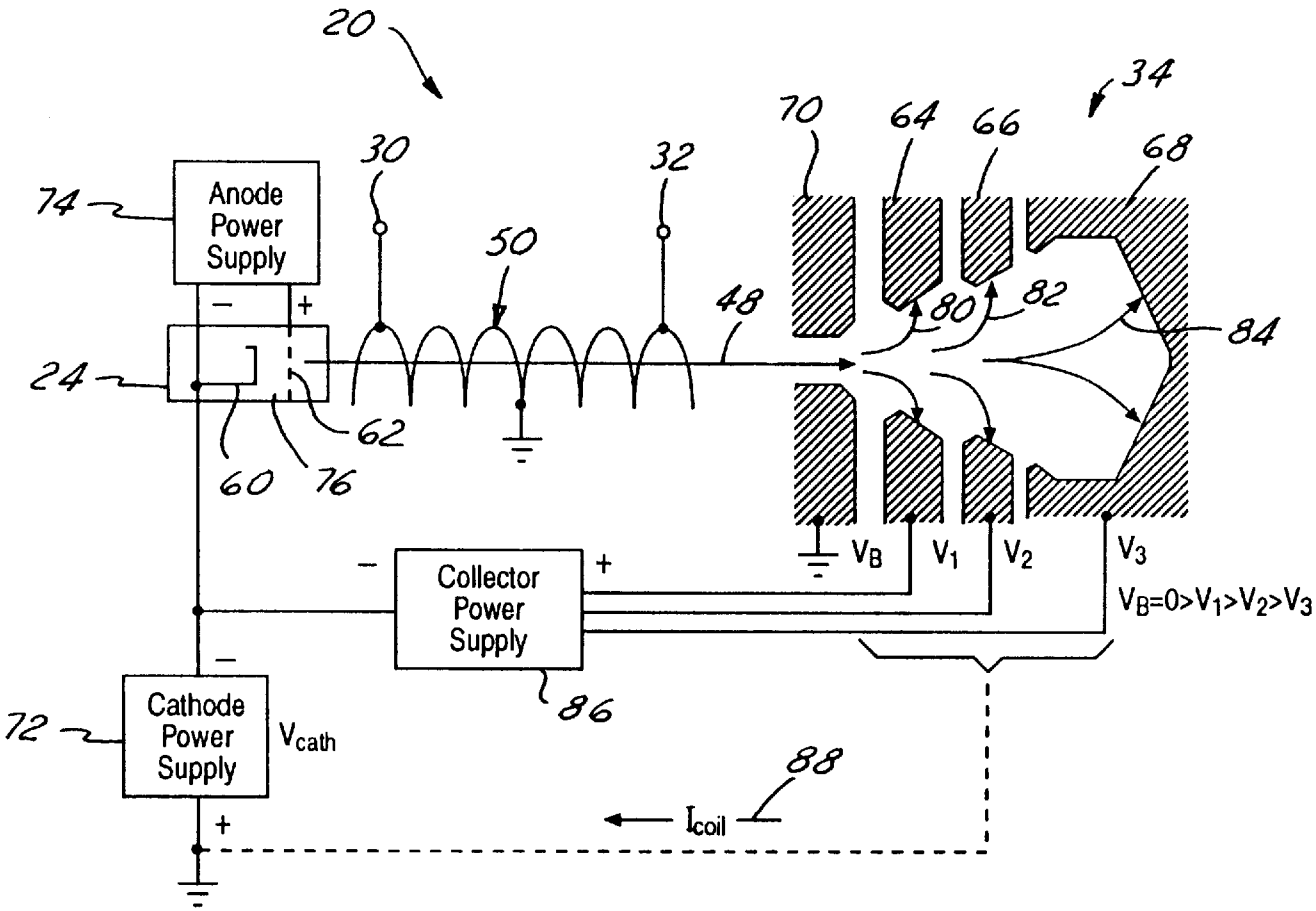
(PRIOR ART) FIG. 3
FIG. 3 is a schematic of the TWT of FIG. 1 which shows a multistage collector.

The DC electron beam is not perturbed because there is no microwave signal applied to TWT 20 (see FIG. 1). Thus, plot 92 shows that there is a minimal energy spread caused by factors associated with cathode 60 and acceleration errors in electron gun 24 (see FIG. 3). Comparing plots 94 and 96 shows that the electron beam is less perturbed at back off as compared to saturation. Plot 94 shows that all of the electrons have at least 5 kV of energy (at least 70% of their initial beam energy) and that there is a spread in the beam energy up to and exceeding the initial cathode voltage of 7 kV. Plot 96 shows that the electron beam at saturation has a high energy spread with some electrons having less energy than the cathode voltage of 7 kV.

A collector of a traveling wave tube running "backed off" or at DC can recover an increasing percentage of the spent beam energy by increasing the number of collector stages. The increase in the number of stages is effective because the electron beam is minimally perturbed and a portion of the beam may reach the additional stages.

Figure 5:
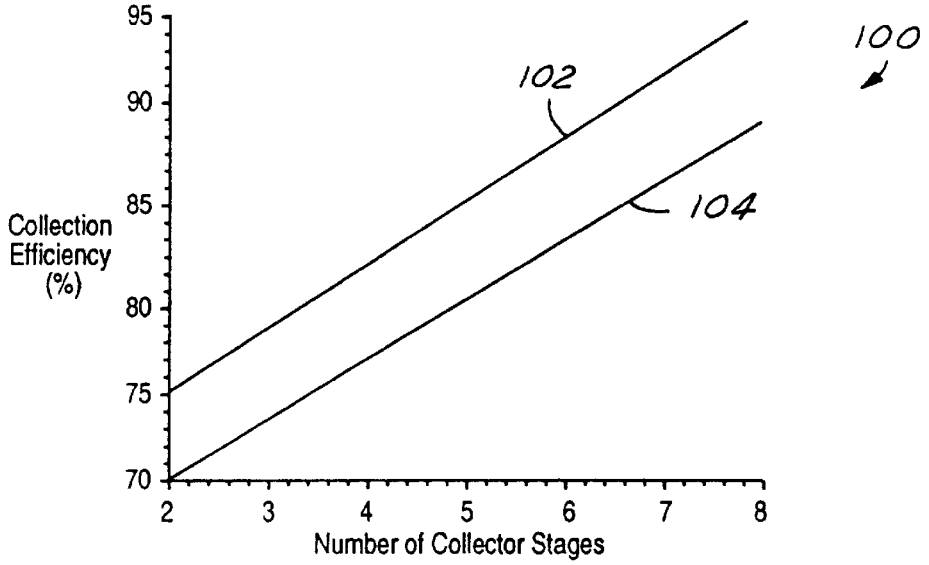
FIG. 5 is a graph of the collection efficiency of a collector of a traveling wave tube operating at DC and back off as a function of the number of collector stages.

The increasing efficiency is shown in FIG. 5 by a graph 100 of the collection efficiency as a function of the number of collector stages. Graph 100 includes plots 102 and 104 of the collection efficiency of a traveling wave tube operating at DC and 8 dB "backed off" from saturation, respectively. FIG. 5 suggests that increasing the number of collector stages past eight will continue to increase the collection efficiency up over 90%. Unfortunately, especially for beams having a perveance of at least 0.25 $\mu$P, this is not true because the beam diverges and blows up by the time it reaches the additional stages. However, the present invention provides an electrostatic focusing lens to increase the collection efficiency of the collector up over 90% by forcing a portion of the beam to reach the additional stages.

In short, to increase the collection efficiency by increasing the number of collector stages, the electron beam must be forced to propagate a sufficient axial distance towards the last and most highly depressed stages. The axial distance is required to stand off the voltage potentials between the stages and physically locate the stages near the axis of the electron beam to collect the electrons. Electron beams that propagate through the collector with little or no confining magnetic field tend to radially expand due to their space charge. In addition, the electron beam is being slowed to a small fraction of its initial velocity by the electric fields in the collector which further increases the space charge causing the beam to radially expand. The electric fields in the collector depend on the voltages applied to the stages and the geometry of the stages.

Figure 6:
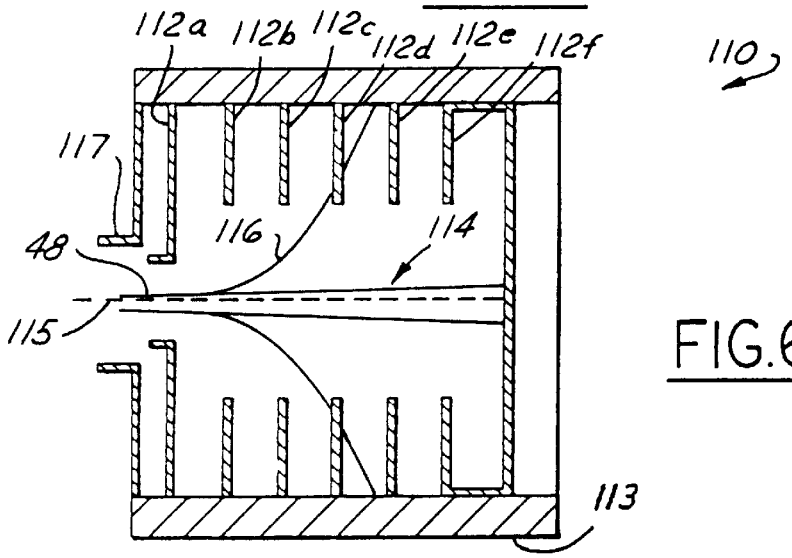
FIG. 6 illustrates the propagation pattern of a 0.1 $\mu$P DC beam for a six stage cylindrically symmetric collector.

Referring now to FIG. 6, the propagation pattern of a 0.1 $\mu$P DC beam 48 is shown for a six stage cylindrically symmetric collector 110. Collector 110 includes stages 112*a*, 112*b*, 112*c*, 112*d*, 112*e*, 112*f* each connected to a bias voltage (not specifically shown) and surrounded by a ceramic isolator 113. An interface flange 117 provides the transition between the traveling wave tube (not shown) and the collector 110. Stages 112*a*, 112*b*, 112*c*, 112*d*, 112*e*, 112*f* are arranged along a common collector axis 115 and are biased toward the cathode potential in sequence (each successive stage is more negative than the previous stage). The stages are axially spaced to hold off the bias voltage of each stage.

With the voltages shut off, the 0.1 $\mu$P DC electron beam propagates through collector 110 towards stage 112*f* with a slight radial expansion as shown by beam profile 114. The radial expansion is slight because the space charge of the low perveance (0.1 $\mu$P) electron beam is relatively small.

With sequential voltages applied to stages 112*a*, 112*b*, 112*c*, 112*d*, 112*e*, 112*f*, the 0.1 $\mu$P DC electron beam propagates through collector 110 with a large radial expansion as shown by beam outline 116. The large radial expansion of the electron beam is caused by the deceleration of the beam as a result of the electric fields from stages 112*a*, 112*b*, 112*c*, 112*d*, 112*e*, 112*f*. However, the 0.1 $\mu$P DC electron beam still propagates to the final collector stages.

Figure 7:
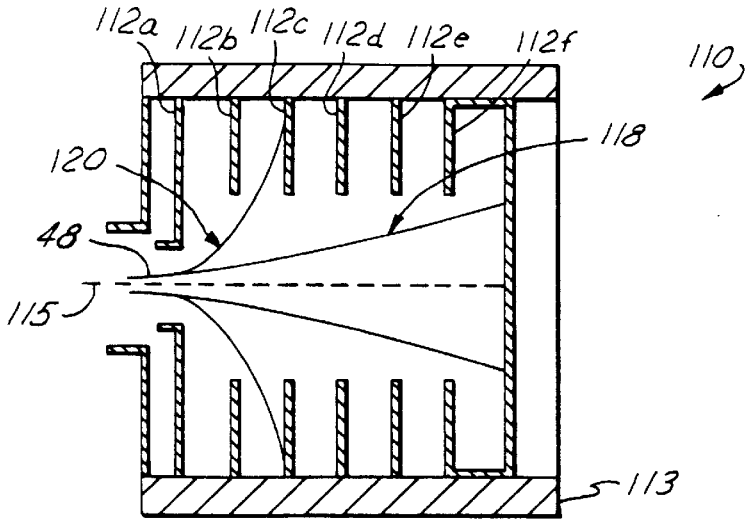
FIG. 7 illustrates the propagation pattern of a 1.0 $\mu$P DC beam for the six stage cylindrically symmetric collector.

In general, as the perveance of the electron beam increases, the radial divergence of the beam in the collector also increases. Referring now to FIG. 7, the propagation pattern of a 1.0 $\mu$P DC electron beam 48 is shown for collector 110. With no voltages applied to stages 112*a*, 112*b*, 112*c*, 112*d*, 112*e*, 112*f*, the 1.0 $\mu$P DC electron beam propagates through collector 110 along collector axis 115 towards stage 112*f* with a large radial expansion as shown by beam profile 118. The radial expansion is large because the space charge of the high perveance (1.0 $\mu$P) electron beam is relatively large. With sequential voltages applied to stages 112*a*, 112*b*, 112*c*, 112*d*, 112*e*, 112*f*, the 1.0 $\mu$P DC electron beam diverges radially rapidly and blows up prior to third stage 112*c* as shown by beam outline 120.

Figure 8:
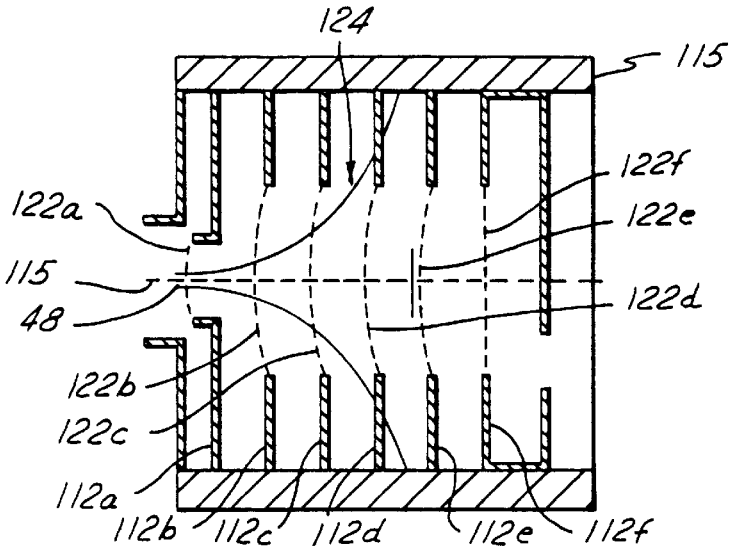
FIG. 8 illustrates equipotential surfaces of each stage of the six stage cylindrically symmetric collector.

In addition to space charge causing the 0.1 $\mu$P electron beam to radially expand, stages 112*a*, 112*b*, 112*c*, 112*d*, 112*e*, 112*f* are normally inherently designed to de-focus the beam to help sort the electrons to different stages. This is shown in FIG. 8 where equipotential surfaces 122*a*, 122*b*, 122*c*, 122*d*, 122*e*, 122*f* of each stage 112*a*, 112*b*, 112*c*, 112*d*, 112*e*, 112*f* for collector 110 is sketched. Equipotential surfaces 122*a*, 122*b*, 122*c*, 122*d*, 122*e*, 122*f* de-focus and force the 0.1 $\mu$P electron beam 48 introduced in FIG. 6 radially outward as shown by beam profile 124 in FIG. 8. This de-focusing lens effect occurs because stages 112*a*, 112*b*, 112*c*, 112*d*, 112*e*, 112*f* are normally biased toward the cathode in sequence to slow the beam monotonically and the stages are axially spaced to hold off the bias voltage of each stage. The de-focusing of the electron beam and the high space charge cause the beam to rapidly expand along the collector axis 115 and be unable to reach the highly depressed stages thereby limiting the collection efficiency.

The present invention provides an electrostatic lens for focusing an electron beam to limit the radial expansion of the beam and focus the beam toward the final highly depressed stages. This increases the collection efficiency by further decelerating the electrons at the electric potential of the final stages. The electrostatic focusing lens is positioned in collector 110 where the electron beam starts to diverge.

The electrostatic focusing lens is effected physically by setting the bias voltage of an intermediate stage more negative than the bias voltage of a successive stage. For instance, because the 1.0 $\mu$P beam shown in FIG. 7 diverges rapidly in the region of third stage 112*c*, the third stage is biased more negatively than fourth stage 112*d* to repel the electrons and force them back toward the axis through collector 110. In alternative embodiments, the bias voltage of the intermediate stage may be more negative than the bias voltages of more than one of the successive stages.

Figure 9:
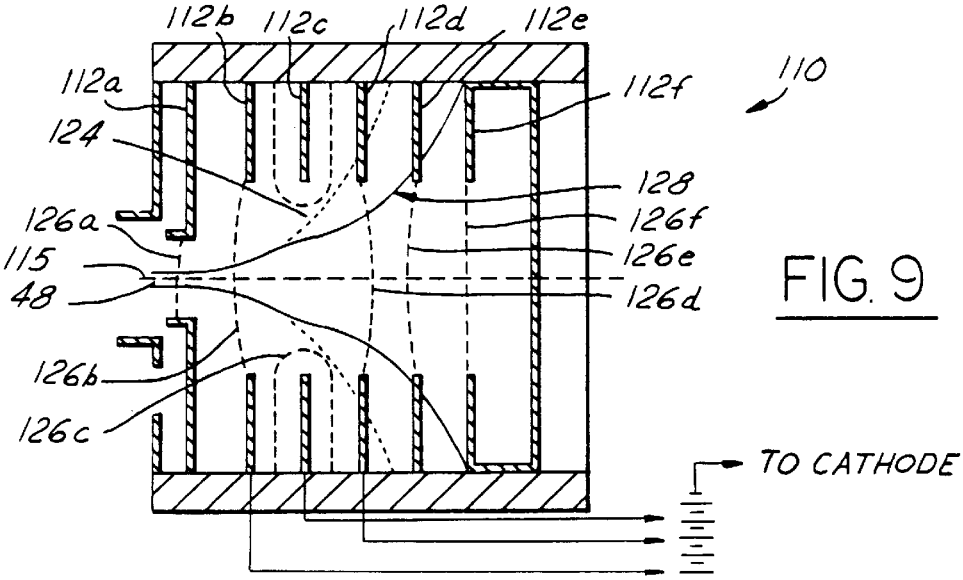
FIG. 9 illustrates equipotential surfaces of each stage of the collector of the present invention.

The focusing of the electron beam 48 by the electrostatic focusing lens is shown by beam profile 128 in FIG. 9. De-focused beam profile 124 is shown by dotted lines for comparison to focused beam profile 128. With focusing, the electron beam 48 does not expand as rapidly along collector axis 115 as a de-focused beam. Thus, the higher stages such as stages 112*e* and 112*f* collect a significant amount of current close to the cathode potential. Equipotential surfaces 126*a*, 126*b*, 126*c*, 126*d*, 126*e*, 126*f* for stages 112*a*, 112*b*, 112*c*, 112*d*, 112*e*, 112*f* are also shown in FIG. 9. Note equipotential surface 126*c* of third stage 112*c* which shows the focusing lens effect of the strongly depressed third stage.

Figure 10:
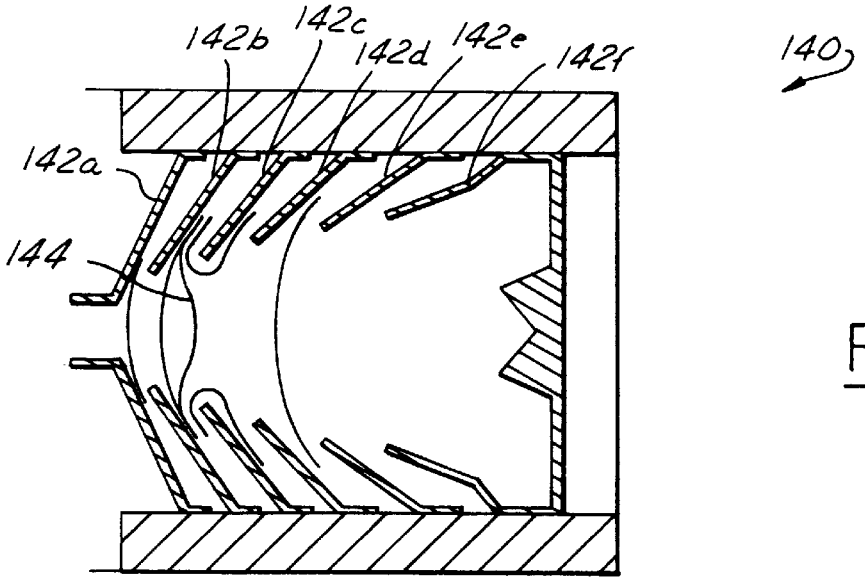
FIG. 10 illustrates a preferred embodiment of the collector of the present invention.

Referring now to FIG. 10, a collector 140 having recessed stages 142*a*, 142*b*, 142*c*, 142*d*, 142*e*, 142*f* is shown. Stages 142*a*, 142*b*, 142*c*, 142*d*, 142*e*, 142*f* are recessed such that their electric field profiles are isolated to the edge of the electron beam as desired. The equipotential surfaces generated by stages 142*a*, 142*b*, 142*c*, 142*d*, 142*e*, 142*f* are also shown. Third stage 142*c* is depressed more negatively than fourth stage 142*d* to cause the electrostatic focusing lens as shown by focusing lens profile 144. Electrostatic focusing lens forces the electrons axially along collector 140 away from the lower depressed stages 142*a*, 142*b*, 142*c* so that they sample the higher depressed stages 142*d*, 142*e*, 142*f*.

Figure 11:
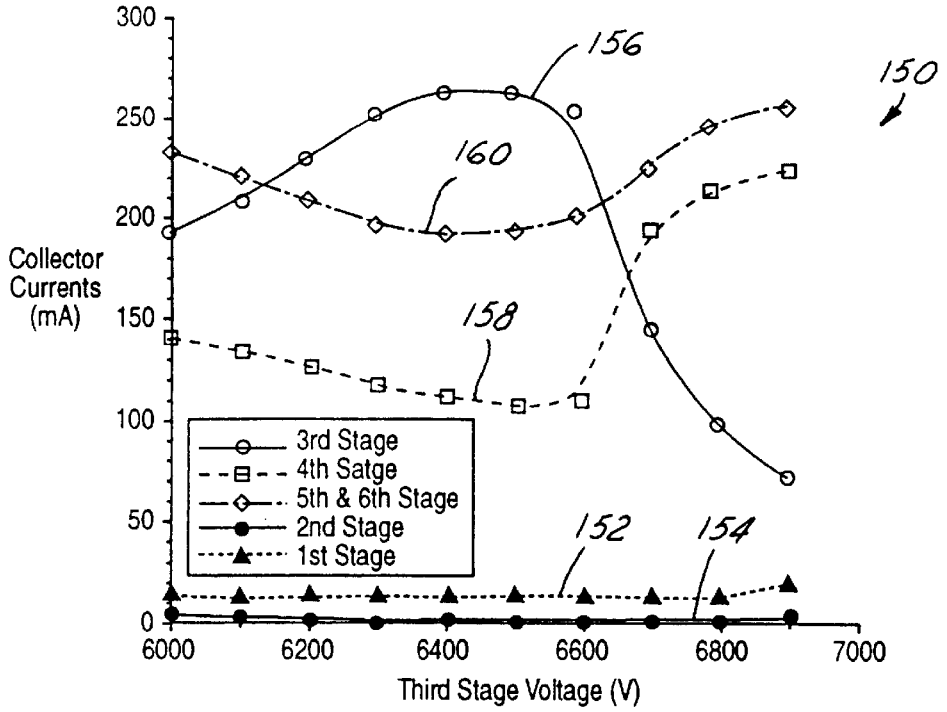
FIG. 11 illustrates the current collected by each stage of the preferred collector embodiment as a function of the voltage of an intermediate stage.

The effect of over depressing third stage 142*c* is shown by graph 150 of FIG. 11. Graph 150 includes plots of the collector current for a DC electron beam collected by each stage as a function of the bias voltage applied to third stage 142*c*. Plots 152, 154, 156, 158, and 160 represent the current collected by stages 142*a*, 142*b*, 142*c*, 142*d*, 142*e* respectively. For this example, the cathode voltage for injecting the electron beam was set at −6.9 kV. First two stages 142*a*, 142*b* were biased at −5.0 kV, fourth stage 142*d* was biased at −6.3 kV, and the last two stages 142*e*, 142*f* were biased at −6.5 kV. Once the bias voltage applied to third stage 142*c* exceeds −6.6 kV, which is more negative than the bias voltage of −6.3 kV for fourth stage 142*d*, the current collected by the last three stages 142*d*, 142*e*, 142*f* increases. The electron beam is not reflected back onto the first two stages 142*a*, 142*b* by the electrostatic focusing lens because the current collected by the first two stages does not increase. This indicates that the electrostatic focusing lens is not an electrostatic mirror.

Figure 12:
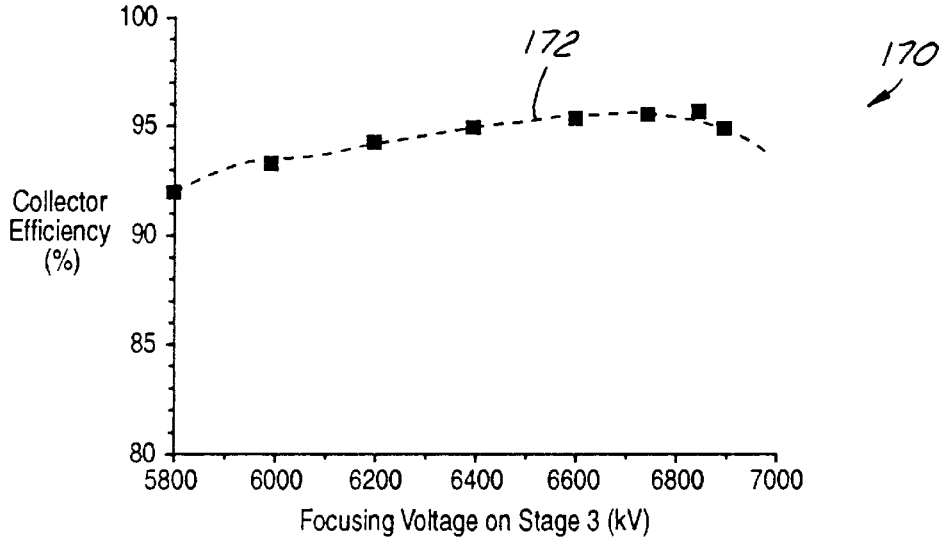
FIG. 12 illustrates the collection efficiency of the preferred collector embodiment as a function of the voltage of an intermediate stage.

Referring now to FIG. 12, the collection efficiency of collector 140 is shown by graph 170. Graph 170 includes a plot 172 of the collection efficiency as a function of the bias voltage applied to third stage 142*c*. The collection efficiency increases from 91.5% to 96% when third stage 142*c* is biased more negatively than fourth stage 142*d*.

Figure 13:
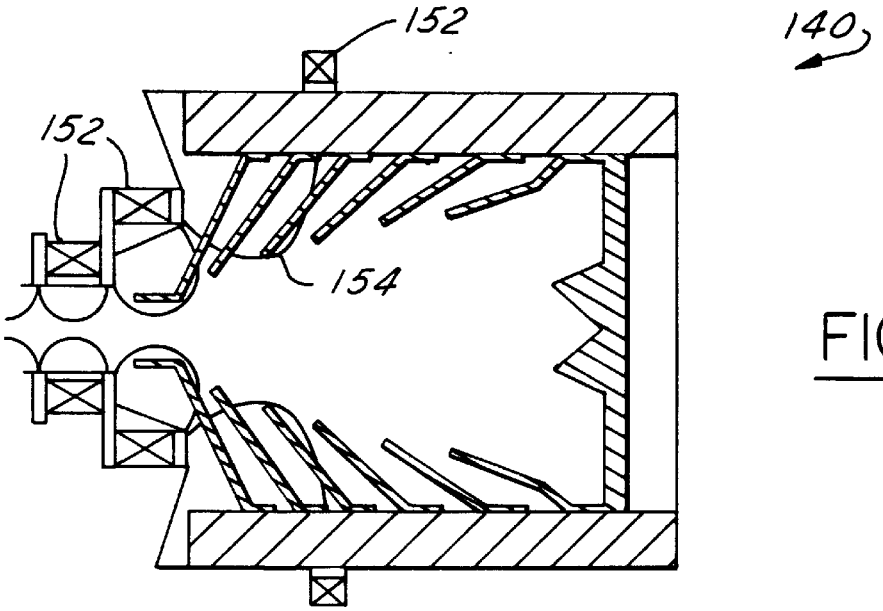
FIG. 13 illustrates a PPM magnetic arrangement adjacent the entrance of the preferred collector embodiment.

In a preferred embodiment, the collection efficiency of collector 140 is increased further by generating a magnetic field in the collector. The magnetic field limits the radial divergence of the electron beam in collector 140. As shown in FIG. 13, a PPM magnetic arrangement 152 is adjacent the entrance of collector 140. PPM magnetic arrangement 152 generates the magnetic field 154, thereby causing an improvement in the electron beam transport towards the higher depressed stages and a reduction in the amount of current collected by the lower depressed stages. The combination of the magnetic field and the electrostatic lens in collector 140 significantly increases the collector efficiency.

As shown, the electrostatic focusing lens in the collector focuses the diverging electron beam toward the farther axially positioned highly depressed stages. The electrostatic focusing lens is effective for TWTs with high perveance beams (>0.25 $\mu$P) and/or for TWTs operating at least 3 dB below saturation with the power of the electron beam at least twenty times greater than the average power of the microwave output signal. Because of the focusing effect, additional stages biased at voltages greater than 90% of the cathode potential may be employed to increase the collection efficiency of a collector.

It should be noted that the present invention may be used in different constructions encompassing many alternatives which are apparent to those with ordinary skill in the art. Accordingly, the present invention is intended to embrace all such alternatives which fall within the spirit and scope of the appended claims.

What is claimed is:

1. A collector for collecting an electron beam in a traveling wave tube, the traveling wave tube having a cathode with a predetermined cathode potential, said collector comprising:

an input end for receiving the electron beam from the traveling wave tube;

a plurality of stages respectively biased at given voltages and arranged along a common collector axis and positioned at different axial positions with respect to the input end wherein a predetermined stage is biased more negatively with a corresponding voltage than a preceding stage and more negatively than a succeeding stage positioned axially farther from the input end, said corresponding voltage of said predetermined stage being greater than 90 percent of said predetermined cathode potential and less than 100 percent of said predetermined cathode potential to thereby provide an electrostatic focusing lens for focusing the electrons on the edges of the electron beam toward succeeding ones of said plurality of stages; and a magnetic focusing device for generating a magnetic field within the collector to guide the electron beam toward the succeeding ones of said plurality of stages.

2. The collector of claim 1 wherein:

the predetermined stage biased more negatively with a corresponding voltage and the succeeding stage positioned axially farther from the input end are immediately adjacent.

3. A traveling wave tube comprising:

an electron gun configured to generate an electron beam, said electron gun having a cathode with a cathode potential;

a slow wave structure configured to receive a wave signal, said slow wave structure positioned so that the electron beam passes through the slow wave structure and configured to cause interaction between the electron beam and the wave signal by converting kinetic energy in the electron beam to microwave energy in the wave signal;

a beam focusing structure arranged to confine the electron beam within the slow wave structure; and a collector for collecting the electron beam, the collector having a predetermined cathode potential, an input end for receiving the electron beam from the slow wave structure and a plurality of stages biased at given voltages and arranged along a common collector axis and positioned at different axial positions with respect to the input end wherein a predetermined stage is biased more negatively with a corresponding voltage than a preceding stage and more negatively than a succeeding stage positioned axially farther from the input end, said corresponding voltage of said predetermined stage being greater than 90 percent of said predetermined cathode potential and less than 100 percent of said predetermined cathode potential to thereby provide an electrostatic focusing lens for focusing the electrons on the edges of the electron beam toward succeeding ones of said plurality of stages; and a magnetic focusing device for generating a magnetic field within the collector to guide the electron beam toward the succeeding ones of said plurality of stages.

4. The traveling wave tube of claim 3 wherein:

the predetermined stage biased more negatively with a corresponding voltage and the succeeding stage positioned axially farther from the input end are immediately adjacent.

5. A method for improving a collection efficiency of a collector of a traveling wave tube, the traveling wave tube having a cathode with a predetermined cathode potential, wherein the collector has an input end for receiving an electron beam from the traveling wave tube and a plurality of stages respectively biased at given voltages and arranged along a common collector axis and positioned at different axial positions with respect to the input end, the method comprising:

generating an electrostatic focusing lens for focusing the electrons on the edges of the electron beam toward succeeding ones of said plurality of stages by biasing a predetermined stage more negatively with a corresponding voltage than a preceding stage and more negatively than a succeeding stage positioned axially farther from the input end, said corresponding voltage of said predetermined stage being greater than 90 percent of said predetermined cathode potential and less than 100 percent of said predetermined cathode potential.

6. The method of claim 5 wherein:

the predetermined stage biased more negatively with a corresponding voltage and the succeeding stage positioned axially farther from the input end are immediately adjacent.

7. The method of claim 5 further comprising:

generating a magnetic field within the collector to guide the electron beam toward successive ones of said plurality of stages.

* * * * *